US005417046A

United States Patent [19]

Setzer

[11] Patent Number: 5,417,046

[45] Date of Patent: May 23, 1995

[54] METHOD OF MANUFACTURING A COMPOSITE YARN HAVING A SPANDEX CORE AND A TEXTURIZED THERMOPLASTIC COVERING

[75] Inventor: Barry D. Setzer, Hickory, N.C.

[73] Assignee: Worldtex, Inc., Hickory, N.C.

[21] Appl. No.: 93,349

[22] Filed: Jul. 16, 1993

[51] Int. Cl.[6] ..... D02G 1/02

[52] U.S. Cl. ..... 57/6; 57/288; 57/289

[58] Field of Search ..... 57/225, 226, 6, 12, 57/284, 287, 288, 289

[56] References Cited

U.S. PATENT DOCUMENTS 3,991,548 11/1976 Toronyi et al. .
4,296,597 10/1981 Tani et al. ..... 57/226 X
4,343,071 8/1982 Schroder .
4,365,466 12/1982 Horiuchi et al. .
4,539,805 9/1985 Ukai et al. ..... 57/287 X
4,674,273 6/1987 Clements et al. .

FOREIGN PATENT DOCUMENTS 38685 10/1981 European Pat. Off. ..... 57/288
0400838 12/1990 European Pat. Off. .

*Primary Examiner*—Joseph J. Hail, III
*Attorney, Agent, or Firm*—Bell, Seltzer, Park & Gibson

[57] ABSTRACT

A method of manufacturing a composite yarn and composite yarn produced thereby in which a spandex yarn is fed to an air entangling or covering jet while being pre-elongated. Simultaneously, a multifilament partially oriented thermoplastic yarn is fed to the yarn entangling or covering jet while being partially or completely drawn to orient further or completely the thermoplastic yarn. The thermoplastic and spandex yarns are fed through the yarn jet while the filaments of the thermoplastic yarn are entangled to produce a composite yarn with the spandex yarn as the core and the thermoplastic yarn as a covering therefor. The composite yarn is then fed through a false twister and false twisted with the false twist being heat set in the thermoplastic yarn at a temperature which does not adversely affect the spandex core to produce an air entangled false twist texturized composite yarn. If not completely oriented when false twisted, the thermoplastic yarn is further drawn to complete its orientation while being false twisted.

7 Claims, 2 Drawing Sheets

METHOD OF MANUFACTURING A COMPOSITE YARN HAVING A SPANDEX CORE AND A TEXTURIZED THERMOPLASTIC COVERING

FIELD OF THE INVENTION

This invention relates to textile yarns and more particularly to composite textile yarns having an elastic core and a covering of non-elastic filaments.

BACKGROUND OF THE INVENTION

Textile yarns having elastic properties are widely used in various textile applications. Spandex yarns are most prevalently used to provide the elastic properties in such textile yarns. Because of the surface characteristics of spandex, however, bare or uncovered spandex yarns have only limited application.

Typically, the spandex is incorporated with other textile fibers or filaments in composite yarns, with the other textile fibers or filaments forming a covering or sheath around the spandex which defines a core within the covering or sheath. Such composite yarns have been heretofore produced by wrapping one or more yarns of the other textile fibers or filaments around the spandex core by passing the spandex core longitudinally and axially through a wrapping spindle during which the covering yarn(s) is wrapped around the core. The density of the covering or sheath may be strictly controlled by the number of wraps per inch of the covering yarn(s) about the spandex core.

While such wrapped, composite yarns have numerous advantages, they also have disadvantages and deficiencies. Such disadvantages and deficiencies include a relatively slow production rate and a relatively limited length of composite yarn produced.

Because of the limitations, disadvantages and deficiencies of such wrapped composite yarns, attempts have been made to provide alternative ways of producing composite yarns, particularly where the covering or sheath is formed of a multifilament thermoplastic yarn. Such attempts have included the entangling of the filaments of a thermoplastic covering yarn with the spandex core by passing both yarns together through an air jet or similar fluid entangling device. Other attempts have included passing the thermoplastic covering yarn and the spandex core together through a friction false twister.

These previously proposed attempts have provided increased rates of production and increased lengths of composite yarns produced. However, the composite yarns produced have exhibited erratic and insufficient coverage and other less than desirable surface characteristics. Additionally, the air entangled composite yarns have typically employed only fully oriented or fully drawn covering yarns.

With the foregoing in mind, it is an object of the present invention to provide a composite elastic yarn and method of manufacturing the same which overcomes the aforementioned limitations, disadvantages and deficiencies of prior composite elastic yarns and methods of manufacture thereof.

SUMMARY OF THE INVENTION

The foregoing object of the invention is accomplished by a method of manufacturing a composite yarn and by the composite yarn produced thereby in which a spandex yarn is fed to an air entangling jet. A multifilament, partially oriented, thermoplastic yarn is also fed to the air entangling jet. The spandex and thermoplastic yarns are fed through the air jet wherein the filaments of the thermoplastic yarn are entangled with each other and with the spandex yarn to produce a composite yarn with the spandex yarn as the core and the thermoplastic yarn as a covering therefor. The thusly produced composite yarn is then fed through a false twister wherein the composite yarn is false twisted and heated to a temperature to set the twist in the thermoplastic yarn, but below a temperature to affect adversely the spandex core to produce an air entangled, false twist texturized composite yarn. The thermoplastic yarn is drawn to complete its orientation in feeding the same to the air jet, or in feeding the same through the false twister or partially in feeding the same to the air jet and partially in feeding the same through the false twister.

In the drawings and specifications, there have been set forth a preferred embodiment of the invention, and although specific terms are employed, they are used in a generic and descriptive sense only and not for purpose of limitation.

DETAILED DESCRIPTION OF THE PREFERRED EMBODIMENTS

Figure 1:
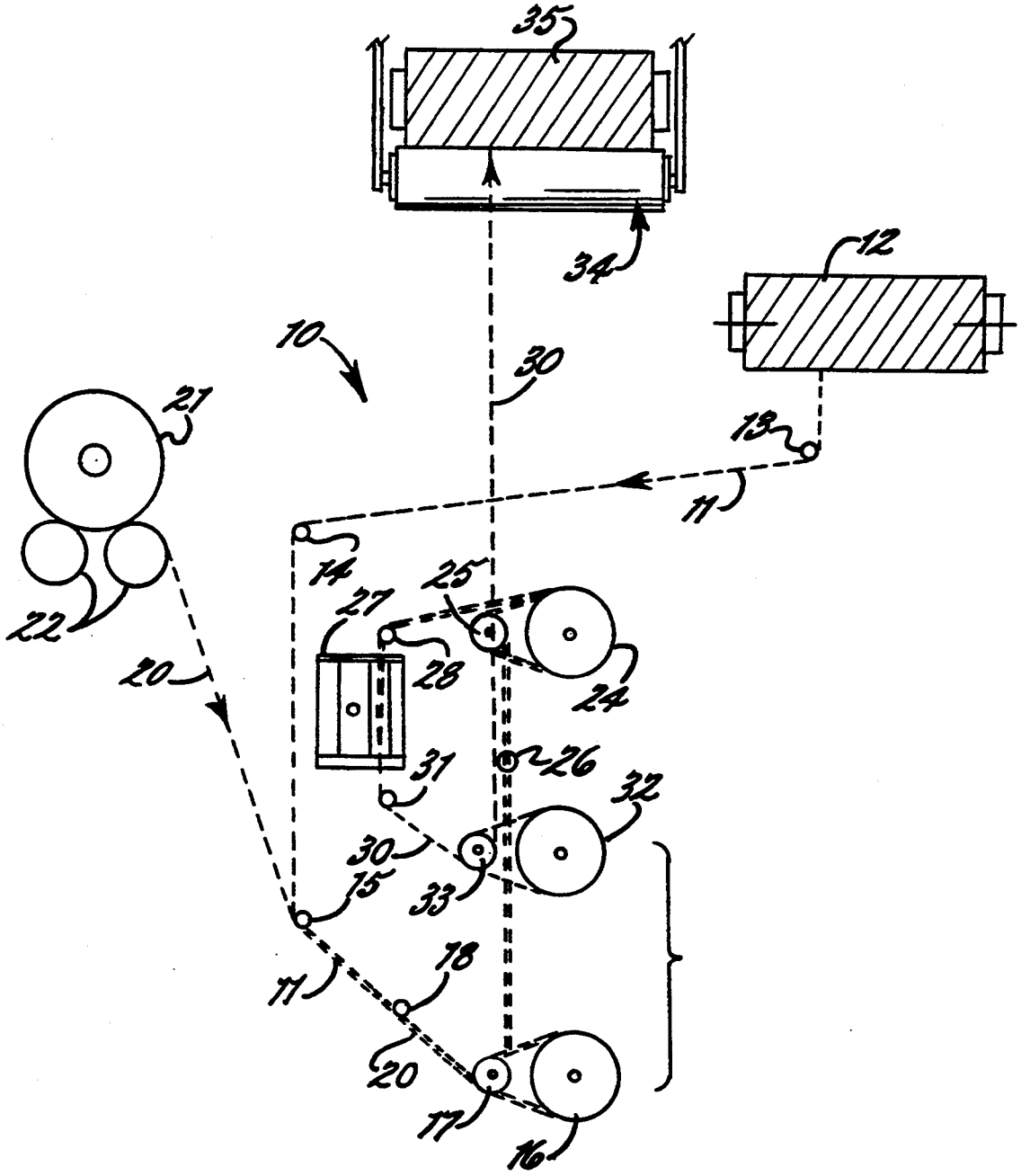
FIG. 1 is a schematic view of the air entanglement of a spandex core and a partially oriented thermoplastic covering in accordance with the present invention.

Referring now more particularly to the drawings and specifically to FIG. 1, an air jet entangling or covering apparatus generally indicated at 10 is schematically illustrated. A multifilament, partially oriented, thermoplastic covering yarn 11 is supplied from a package 12 supported for unwinding rotation in a manner not shown. Thermoplastic covering yarn 11 will be selected depending upon the characteristics desired in the finished yarn. Probably most frequently, the covering yarn 11 will preferably be nylon 6.6. Covering yarn 11 is fed from package 12 partially around a first guide 13, a second guide 14, and a third guide 15 to a pair of first draw rolls 16 and 17 by way of a fourth guide be. Covering yarn 11 is wrapped from 5 to 7 times around the draw rolls 16 and 17.

A spandex core yarn 20 is supplied by a package 21 supported by a pair of supply rolls 22. Spandex core yarn 20 may be monofilament or multifilament depending upon the characteristics desired in the finished yarn. Spandex core yarn 20 passes partially around the guides 15 and 18 to the first pair of draw rolls 16 and 17. As with covering yarn 11, spandex core yarn 20 is wrapped from 5 to 7 times around draw rolls 16 and 17 in parallel convolutions to covering yarn 11.

Supply rolls 22 are suitably driven in a manner not shown to supply core yarn 20 positively. Draw rolls 16 and 17 are driven in a manner not shown to provide a surface speed of draw rolls 16 and 17 relative to the surface speed of supply rolls 22 such that the spandex core yarn 20 is pre-elongated between supply rolls 22 and draw rolls 16 and 17. The amount of pre-elongation of core yarn 20 may vary, but typically will be from about 230% to 270%.

From first draw rolls 16 and 17, covering yarn 11 and core yarn 20 are fed to a second pair of draw rolls 24 and 25 through an eyelet-type guide 26. Yarns 11 and 20 are again wrapped around second draw rolls 24 and 25 from 5 to 7 times to ensure against slippage between the surfaces of draw rolls 24, 25 and yarns 11 and 20.

Preferably, first draw rolls 16, 17 and second draw rolls 24, 25 are rotated at relative surface speeds such that the partially oriented covering yarn 11 is further drawn between first draw rolls 16, 17 and second draw rolls 24, 25 to orient the covering yarn 11 a partial amount relative to that needed to orient completely the yarn 11. Still more preferably, the draw of yarn 11 between first draw rolls 16, 17 and second draw rolls 24, 25 is 50% or one-half of that needed to complete the orientation of yarn 11. The amount of draw needed to complete the orientation of partially oriented thermoplastic yarns varies from yarn-to-yarn. Typically, such further draw varies from about 15% to 30% depending on the type of yarn.

Spandex core yarn 20 is further stretched or elongated between first draw rolls 16, 17 and second draw rolls 24, 25. The amount of such further elongation is equal to the amount of draw of covering yarn 11. Compared to the amount of pre-elongation between supply rolls 22 and first draw rolls 16, 17, this further elongation of core yarn 20 is quite small.

Second draw rolls 24, 25 feed covering yarn 11 and core yarn 20 to an air jet 27 over a first air jet guide 28 in parallel, contiguous relation. Covering yarn 11 and core yarn 20 pass through the air jet 27 where the filaments of the covering yarn 11 are air entangled with core yarn 20. Due to the greater tension in core yarn 20 because of the pre-stretching or pre-elongation thereof, covering yarn 11 forms a covering or sheath around core yarn 20 in the air jet 27 to form a composite yarn 30.

Composite yarn 30 exits the air jet 27 and passes over a second air jet guide 31. Composite yarn 30 then passes to a pair of delivery rolls 32, 33, about which it is wrapped from 5 to 7 times. Delivery rolls 32, 33 are driven in a manner not shown to provide a surface speed thereof such that second draw rolls 24, 25 overfeed covering yarn 11 and core yarn 20 to air jet 27. The amount of such overfeed may vary, but typically it should be about 6% to 11%.

Composite yarn 30 leaves delivery rolls 32, 33 by passing between such rolls and thence to a take-up means 34. Take-up means 34 winds composite yarn 30 into a yarn package 35. If desired, composite yarn 30 may proceed directly to further processing without being wound into the package 35.

The air jet entangling or covering apparatus 10 just described is well known to persons skilled in the yarn throwing art. One such machine is manufactured and sold by D. Giudici and Figli of Italy.

Figure 2:
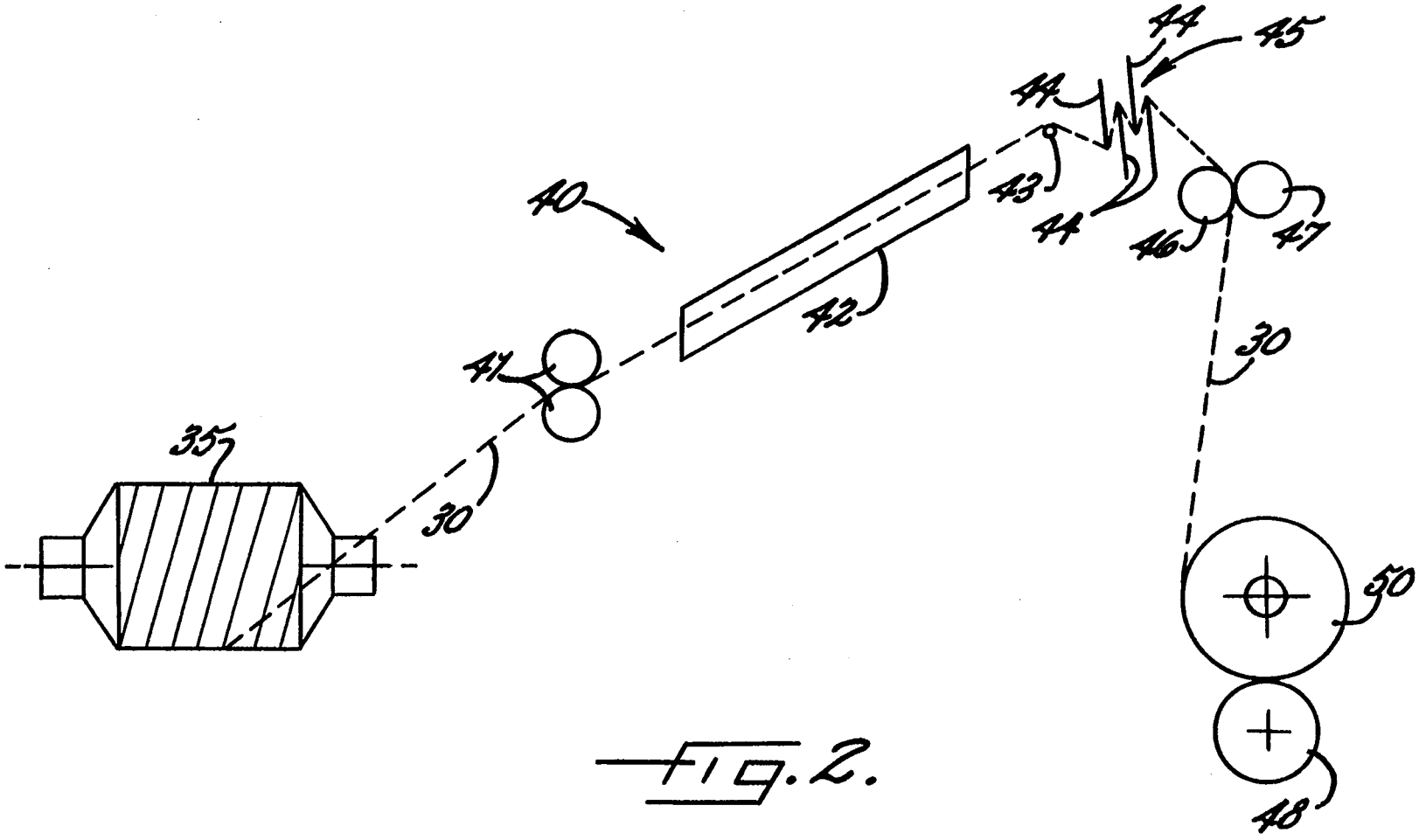
FIG. 2 is a schematic view of the false twist texturizing of the composite yarn produced in accordance with the illustration of FIG. 1.

The composite yarn package 35 is next placed in the creel (not shown) of a false twisting apparatus, generally indicated at 40 and illustrated schematically in FIG. 2. Such false twist apparatus is well known to yarn throwsters and one such machine is manufactured and sold by D. Giudici and Figli of Italy.

Composite yarn 30 is unwound from package 35 by a pair of feed rolls 41. Composite yarn 30 then passes through a heater 42. However, unlike conventional false twisting, composite yarn 30 does not contact heater 42, but is heated thereby solely by convection. From heater 42, composite yarn 30 passes through a guide 43 and engages the peripheries of rotating discs 44 of a conventional friction false twist means 45. Discs 44 of friction false twist means 45 impart false twist to composite yarn 30 which backs-up through guide 43 and heater 42 to the feed rolls 41.

The false twisted composite yarn 30 is heated by heater 42 to a temperature sufficient to set the twist in thermoplastic covering yarn 11, but insufficient to affect adversely spandex core yarn 20. In conventional false twisting, it is common to heat thermoplastic yarns to temperatures of about 200° C. to about 220° C. when such yarns are nylon 6.6. However, such high temperatures would adversely affect spandex core yarn 20. Accordingly, composite yarn 30 is preferably heated to a temperature of about 140° C. to about 160° C.

After leaving discs 44 of friction false twister 45, composite yarn 30 passes through the nip of a pair of draw rolls 46, 47. Draw rolls 46, 47 are driven in a manner not shown to provide a surface speed relative to feed rolls 41 such that composite yarn 30 is elongated between feed rolls 41 and draw rolls 46, 47 by an amount sufficient to draw further covering yarn 11 by an amount sufficient to complete the orientation of the partially oriented covering yarn 11.

While it is preferred by this invention that the partially oriented covering yarn 11 have its orientation completed by being drawn partially in both the air entangling apparatus be and in the false twist apparatus 40, it is contemplated by this invention that such partial orientation could be completed by having the covering yarn 11 fully drawn in either the air entangling apparatus be or in the false twist apparatus 40. The best finished yarn characteristics have been achieved when such orientation is completed by a draw of about 50% or one-half of the amount of draw needed to complete orientation of covering yarn 11 is accomplished in each of the air entangling apparatus 10 and the false twist apparatus 40.

From draw rolls 46, 47, composite yarn 30 is wound by a take-up means 48 into a finished yarn package 50. Rolls 46, 47 are driven in a manner not shown such that the surface speed thereof is greater than the surface speed of take-up means 48 such that the composite yarn 30 is overfed by a predetermined amount onto package 50.

In the drawings and specifications, there has been set forth a preferred embodiment of the invention, and although specific terms are employed, they are used in generic and descriptive sense only and not for purpose of limitation.

That which is claimed is:

1. A method of manufacturing a composite yarn having a spandex core and a covering of a texturized thermoplastic wrapping yarn, said method comprising the steps of (a) feeding a spandex core yarn along a first predetermined path of travel to an air jet, (b) feeding a partially oriented thermoplastic, multifilament covering yarn along a second predetermined path of travel to the air jet while (c) drawing the partially oriented thermoplastic covering yarn a predetermined amount less than the amount required to fully orient the covering yarn to partially further orient the covering yarn, (d) feeding the spandex core yarn and the thermoplastic covering yarn through the air jet in parallel, contiguous relation while (e) entangling pneumatically the filaments of the covering yarn with the spandex core yarn to produce an entangled composite yarn with the spandex yarn substantially defining the core of the composite yarn and the thermoplastic yarn substantially defining a covering therearound, and (f) feeding the entangled composite yarn through a false twister while false twisting and heating the yarn to a temperature where the twist is set into the thermoplastic yarn and while (g) drawing the thermoplastic yarn to complete the orientation thereof.

2. A method according to claim 1 wherein the thermoplastic yarn is drawn while being fed along the second predetermined path of travel by approximately 25% to 75% of the draw needed to complete the orientation of the thermoplastic yarn.

3. A method according to claim 2 wherein the thermoplastic yarn is drawn by approximately 50% of the draw needed to fully orient the yarn while it is being fed along the second predetermined path of travel.

4. A method according to claim 1 wherein the thermoplastic yarn is nylon.

5. A method according to claim 1 wherein the spandex core yarn is in an elongated or stretched condition when fed through the air jet.

6. A method according to claim 1 wherein the composite yarn is heated without physical contact with the heater of the false twister through which the composite yarn is being fed.

7. A method of manufacturing a composite yarn having a spandex core and a covering of a texturized thermoplastic wrapping yarn, the method comprising the steps of (a) feeding a spandex core yarn along a first predetermined path of travel to an air jet, (b) feeding a partially oriented nylon, multifilament covering yarn along a second predetermined path of travel to the air jet while (c) drawing the nylon covering yarn by approximately 50% of the draw needed to fully orient the covering yarn, (d) feeding the spandex core yarn and the nylon covering yarn through the air jet in parallel, contiguous relation while (e) entangling pneumatically the filaments of the nylon covering yarn with the spandex core yarn to produce a composite yarn with the spandex yarn substantially defining the core of the composite yarn and the nylon yarn substantially defining a covering therearound, and (f) feeding the composite yarn through a false twister while false twisting and heating the composite yarn to a temperature where the twist is set into the nylon yarn, while (g) drawing the nylon thermoplastic yarn by an additional approximately 50% to complete the orientation thereof.

* * * * *

UNITED STATES PATENT AND TRADEMARK OFFICE

CERTIFICATE OF CORRECTION

PATENT NO. : 5,417,046

DATED : May 23, 1995

INVENTOR(S) : Setzer

It is certified that error appears in the above-identified patent and that said Letters Patent is hereby corrected as shown below:

Column 2, line 46, delete "be" and insert -- 18 --;

Column 4, line 26, delete "be" and insert -- 10 --;

Column 4, line 30, delete "be" and insert -- 10 --.

Signed and Sealed this

Twenty-ninth Day of August, 1995

Bruce Lehman

*Attest:*

BRUCE LEHMAN

*Attesting Officer*

*Commissioner of Patents and Trademarks*